US005956905A

United States Patent [19]

Wiedrich

[11] Patent Number: 5,956,905

[45] **Date of Patent: *Sep. 28, 1999**

[54] MANHOLE ADJUSTING EXTENSION MEMBER

[76] Inventor: Dwight G. Wiedrich, 244 Woodridge Ln., Lino Lakes, Minn. 55014

[ * ] Notice: This patent issued on a continued prosecution application filed under 37 CFR 1.53(d), and is subject to the twenty year patent term provisions of 35 U.S.C. 154(a)(2).

[21] Appl. No.: 08/795,548

[22] Filed: Feb. 6, 1997

[51] Int. Cl.[6] ..... E02D 29/14

[52] U.S. Cl. ..... 52/20; 52/19; 404/25; 404/26; 220/220

[58] Field of Search ..... 52/19, 20, 21; 404/25, 26; 220/220

[56] References Cited

U.S. PATENT DOCUMENTS

| | | | |
|---|---|---|---|
| 1,639,495 | 8/1927 | Frame . | |
| 2,593,918 | 4/1952 | Redman . | |
| 3,773,428 | 11/1973 | Bowman . | |
| 4,121,390 | 10/1978 | Hall et al. . | |
| 4,187,647 | 2/1980 | Hall . | |
| 4,188,151 | 2/1980 | Hall . | |
| 4,236,358 | 12/1980 | Bowman . | |
| 4,408,421 | 10/1983 | Pai . | |
| 4,690,584 | 9/1987 | LeBaron . | |
| 4,759,656 | 7/1988 | Wilson . | |
| 4,763,449 | 8/1988 | Vigneron et al. . | |
| 4,772,154 | 9/1988 | Caroulle . | |
| 4,834,574 | 5/1989 | Bowman . | |
| 4,844,402 | 7/1989 | Werner . | |
| 4,976,568 | 12/1990 | Hess . | |
| 5,030,030 | 7/1991 | Simmonds . | |
| 5,044,818 | 9/1991 | Pritchard . | |
| 5,051,022 | 9/1991 | Bowman . | |
| 5,143,478 | 9/1992 | Bowman . | |
| 5,205,668 | 4/1993 | Adams . | |
| 5,209,601 | 5/1993 | Odill et al. . | |
| 5,211,504 | 5/1993 | Trudel . | |
| 5,221,155 | 6/1993 | Neil . | |
| 5,362,175 | 11/1994 | Begin . | |
| 5,442,882 | 8/1995 | Repasky | 52/263 X |
| 5,470,172 | 11/1995 | Wiedrich . | |
| 5,513,926 | 5/1996 | Prescott . | |
| 5,529,431 | 6/1996 | Walsh . | |
| 5,536,110 | 7/1996 | Tompkins et al. . | |
| 5,564,855 | 10/1996 | Anderson | 52/21 X |
| 5,595,455 | 1/1997 | Svirklys . | |

FOREIGN PATENT DOCUMENTS

| | | |
|---|---|---|
| 2270708 | 3/1994 | United Kingdom . |

OTHER PUBLICATIONS

"Ingenious By Nature", Enviromax Rubber, Inc., Ontario Centre for Environmental Technology Advancement (OCETA), Enviro Frames and Enviro Levelling Rings, Oct. 1995.

*Primary Examiner*—Carl D. Friedman
*Assistant Examiner*—Winnie S. Yip
*Attorney, Agent, or Firm*—Nikolai, Mersereau & Dietz P.A.

[57] ABSTRACT

A molded plastic extension member for use in increasing the height of manholes, or catch basins when surfacing or resurfacing a roadway. The extension member may be formed having a sloping upper planar support surface to thereby adjust the angle of the catch basin support frame or the manhole cover support frame. An outer surface of the extension member includes indicia that allows the user to align the slope of the upper planar support surface parallel with the roadway surface. When several sloped extension members are stacked, the indicia may be used to create a complex angle of slope relative to the underlying base members vertical axis. The extension member includes a pocket adaptable for receiving and retaining mortar between two stacked extensions. Planar surfaces may extend from both the upper and lower edge of the extension member, thereby providing support and added stacking surface for the stacked extension members. The extension member also includes a tapered shoulder that interlocks with either the manhole cone, the catch basin cone, or with other stackable angled plastic members.

43 Claims, 16 Drawing Sheets

MANHOLE ADJUSTING EXTENSION MEMBER

BACKGROUND OF THE INVENTION

I. Field of the Invention

This invention relates generally to manhole and catch basin structures and, more particularly, relates to a stackable plastic extension member positionable between the open top surface of a base of a manhole or catch basin and the bottom surface of a support frame. The extension may be used to elevate a manhole cover support frame or a catch basin grating support frame, wherein the central axis of the manhole cover support frame or catch basin grating support may be aligned either parallel to or at an angle relative to the vertical axis of the manhole or catch basin. The angle relative to the vertical axis of the manhole or catch basin may be compounded at a simple or complex angle by stacking a plurality of extensions. The plastic extension may include a combination of upward and downward facing pockets, whereby there is an increase in surface area of both portions of the extension ring that contact the top of the base of the manhole or catch basin and the bottom of the manhole cover support frame or catch basin grating support frame.

II. Discussion of the Prior Art

Roadways or streets often include manholes or catch basins, allowing access to underground sanitary and storm sewers and utility conduits. A manhole may generally comprise a base having concentric sides extending upward, a cone mounted above the base (usually of a monolithic, tubular, conical, or cylindrical cast made of concrete or brick), a cast iron support frame and a cover. The cast iron support frame is positioned above the cone and supports the cover. During roadway construction or resurfacing, the concrete manhole structure is built up to an elevation so that the cover will be positioned approximately flush with the road level. One or more concrete spacers may be positioned between the cast iron support frame and cone, to ensure that the cover will be flush with the road surface.

Catch basins are constructed along the curb line of roadways or streets to allow surface water drainage into underground storm sewers. The catch basin structure is similar to the manhole structure. The catch basin, when first constructed, comprises a base with concentric sides extending upward, a cone resting above the base with a rectangular, cylindrical, oblong, etc. cross-section on which is mounted a cast iron support frame having a rectangular opening that supports a rectangular grating. Sometimes, a rectangular top slab may be positioned directly above the cone. The rectangular top slab is used to narrow the opening in the cone and supports either a rectangular or concentric cast iron support frame. When the catch basin structure is built up to an elevation to ensure that the grating will be approximately at road level, rectangular spacers are employed between the cone or top slab and the cast iron support frame.

Occasionally, the manhole and catch basin are constructed on a hillside. Usually, the base of the manhole or catch basin is aligned vertically with the earth's gravitational line, not perpendicular to the surface or the hillside's vertical line. In order to avoid having a recess (pothole) in the roadway, the manhole cover or grating must be supported at an angle or slope relative to the base, wherein the slope is equal to the angle between the gravitational line and the hillside vertical line. To further complicate matters, the hillside may also be curved, creating a complex angle between the plane of the manhole cover and the vertical axis of the manhole base. Thus, a need exists to efficiently change the angle of the manhole cover and grating to be flush with the resurfaced roadway.

The prior art has recognized a need to efficiently raise the level of the manhole flush with the resurfaced roadway. To meet this need, a variety of adapter rings and adjustment rings have been introduced, such as that described in U.S. Pat. No. 5,470,172 (hereinafter the '172 patent) issued to Wiedrich. The '172 patent shows and describes an extension ring that is positioned between the upper surface of the monolithic cone and the bottom surface of the support frame casting. One embodiment of the extension ring described in the '172 patent includes downward facing pockets formed by inner and outer sidewalls and webs extending between the sidewalls. In use, it is difficult to fill the downward facing pockets with mortar or other similar filler. Also, wedges 11 are shown and described to engage with the webs, changing the slope of the planar support surface of the extension ring. The use of wedges may not allow the user to easily create a desired complex slope angle. The use of wedges also requires additional steps of alignment and positioning. Further, all the weight/force is localized on the webs and outer wall. Hence, a need exists for an extension member that spreads out the bearing weight over a substantial portion of the top surface of the cone, wherein the extension member may be used to easily create a desired complex slope angle. The present invention meets these and other needs.

SUMMARY OF THE INVENTION

The purpose of the present invention is to provide a durable, stackable, plastic support and spacer member, wherein the support member allows the central axis of the manhole cover or grating to be supported at any of several predetermined complex angles relative to the manhole base or cone, thereby allowing the cover or grating to remain flush with a resurfaced roadway located on a hillside. Without any limitation intended, the support member may molded from a variety of post consumer (recycled) plastics while maintaining structural support requirements, allowing the user to mold the support member from any of several of the most readily available recycled plastics.

The plastic support member is also designed to be aligned between the open top surface of a base of a manhole or catch basin and the bottom surface of a support frame, to thereby elevate the support frame. The plastic support member includes both an upper support surface and a lower support surface. In the case of a flawed or imperfect top surface of the cone, the lower planar support surface extends across a substantial portion of the cone's top surface to improve surface contact between the imperfect cone and the plastic support member.

The molded plastic member comprises inner, central and outer concentric sidewalls, partitions that define pockets and interconnect the side walls, an upper planar support surface, a lower planar support surface, and an upper and lower shoulder extending from a center portion of the inner wall. Downward facing pockets defined by an upper planar support surface, partitions and sidewalls will be referred to as "pockets down". Upward facing pockets defined by a lower planar support surface, partitions and sidewalls will be referred to as "pockets up". A combination of both pockets up and pockets down will be referred to as "pockets up/down".

In order for the plastic member to be sealably positioned between the cone top surface and the support frame, the plastic member is shaped to conform to the upper top edge of the cone and the support frame. Thus, the plastic member may take on any of several shapes including, without limitation, an annular member, a rectangle, a square or other geometric conforming shape, noting however, that an annular member is preferred for the manhole, and a rectangular ring is preferred for the catch basin. Those skilled in the art will appreciate that the construction described below of the plastic member may remain the same for any conforming shape of the plastic member.

The inner vertical annular wall has an upper and lower section that is radially offset relative to a center section, thereby defining an upper and lower annular shoulder. The lower annular shoulder is designed to interlock with the upper annular shoulder of other plastic members. A caulking may be applied between the two annular shoulders creating a watertight seal. The lower annular shoulder of the bottommost annular member also interlocks with fictile concrete poured on the cone top surface.

In use, the plastic member is positioned on the top surface of the cone with the lower annular shoulder projecting downward into the central cone opening. The lower annular shoulder interlocks with the cone preventing excessive lateral movement of the plastic member. The user may continue to align and stack plastic members until the desired height for the top surface has been reached. A caulk may be applied between each of the engaged surfaces forming a water tight seal between any interlocked plastic members, the support frame, and the cone.

The present invention may be used in newly constructed roads or in resurfacing existing roadways. In surfacing or resurfacing roads, the desired number of interlocking annular members multiplied by the thickness of each annular member is made to equal the height needed to make the cover or grating flush with the roadway. When the desired number of annular members has been determined and put in place, the support frame may be aligned and engaged on top of the uppermost annular member. The manhole cover or grating is then positioned on the support frame. The road may then be surfaced or resurfaced with the manhole cover and grating's level being the same as the surfaced or resurfaced road level.

When constructing or resurfacing a roadway on a hillside, the desired slope relative to both the vertical and horizontal axes of the roadway may be determined. If the desired slope requires a complex angle (a slope in both the horizontal and vertical directions), then a plurality of sloped plastic members may be used to create an upper support surface at the desired complex angle. The angle of the cover or grating is changed relative to the cone, causing the manhole cover and grating to be flush with the resurfaced roadway.

The sloped plastic member may have a varying thickness, wherein the height dimension of the outer wall decreases uniformly from a first height dimension associated with a first side position of the outer wall to a second height dimension associated with a second side position of the outer wall aligned opposite the first side, thereby creating a sloped upper support surface or plane. An external surface of the outer wall may have a plurality of equally spaced markings or other indicia associated with the first height dimension of each plastic member. Without any limitation intended, the markings may consist of 360 vertical lines equally spaced about the perimeter of the annular member. The marking may be used to assist the user in quickly positioning the slope of the upper surface in a desired alignment within the roadway.

When several plastic members are stacked together, the markings of each plastic member may be aligned relative to the other to thereby create the desired complex slope angle and/or increase the angle of the slope relative to the vertical axis of the base or cone. The degree of slope is dependent upon the number of stacked plastic members and the alignment of the first height dimension of each plastic member relative to the others. When the position associated with the first height dimension of each stacked plastic member is offset relative to the other, the slope of the uppermost plastic member is aligned at a complex angle relative to the vertical axis of the manhole base or cone, thereby allowing the cover or grating to remain flush with a resurfaced roadway located on a banking hillside.

In an alternate embodiment, the molded plastic member comprises inner and outer side walls, partitions that define upward facing pockets and interconnect the side walls, a lower planar support surface, and an upper and lower shoulder extending from a center portion of the inner wall. Once the plastic member is positioned above the base, the pockets defined by the partitions and lower planar support surface are adapted for receiving mortar therein, to thereby form a solid support member. An additional plastic member or the support frame may be stacked on top of the mortar. The upper edge of the sidewalls defining the upper planar support surface may be sloped as described above.

OBJECTS OF THE INVENTION

It is accordingly a principal object of the present invention to provide stackable, interlocking, spacer members for use in elevating a cover or grating of a respective manhole or catch basin to the desired level of the roadway, wherein the stackable spacer members include both upper and lower planar bearing surfaces for engagement with the support frame and cone respectively.

Another object of the present invention to provide a stackable, lightweight spacer member having upper and lower planar bearing surfaces, wherein the upper bearing surface is sloped to thereby change the angle of the manhole cover or grating relative to the top slab or cone.

A further object of the present invention is to provide a lightweight, interlockable, spacer member having upward opening pockets formed therein for receiving mortar after the spacer member is positioned or stacked above the cone.

Still another object of the present invention is to provide a spacer member having a sloped upper support surface to thereby change the angle of the manhole cover or grating relative to the top slab or cone, wherein indicia is included about a circumference of the spacer member to thereby accurately determine the angle between the manhole cover or grating and the top slab or cone.

A further object of the present invention is to provide manhole and catch basin adjustment spacers of high compressive strength.

Another object of the present invention is to provide manhole and catch basin adjustment spacers made from post-consumer (recycled) plastics that are durable, and better capable of withstanding relatively high impacts, inclement climates, and exposure to road salt and other chemicals as compared to concrete.

These and other objects, as well as these and other features and advantages of the present invention will become readily apparent to those skilled in the art from a review of the following detailed description of the preferred embodiment in conjunction with the accompanying claims and drawings in which like numerals in the several views refer to corresponding parts.

The present invention represents a variety of improvements to the spacer member which can take the form in any of a great variety of embodiments. The detailed embodiments are taken as representative or exemplary of those in which the improvements of the invention may be incorporated and are not presented as being limiting in any manner.

DETAILED DESCRIPTION OF THE PREFERRED EMBODIMENT

Figure 1:
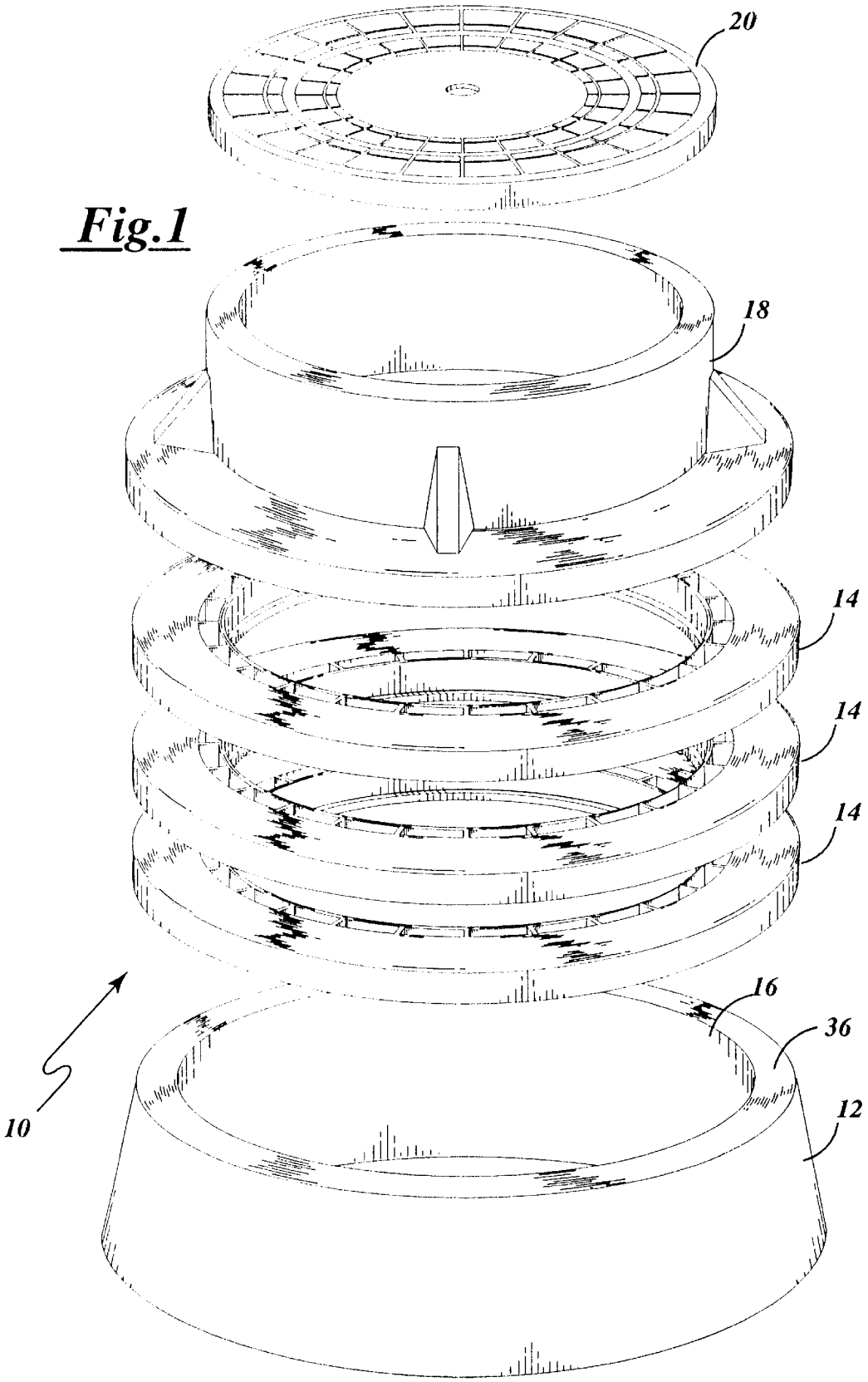
FIG. 1 is an exploded fragmentary perspective view of a manhole cone, a plurality of molded plastic annular spacer members of the present invention, a manhole cover support frame and a manhole cover.
Figure 2:
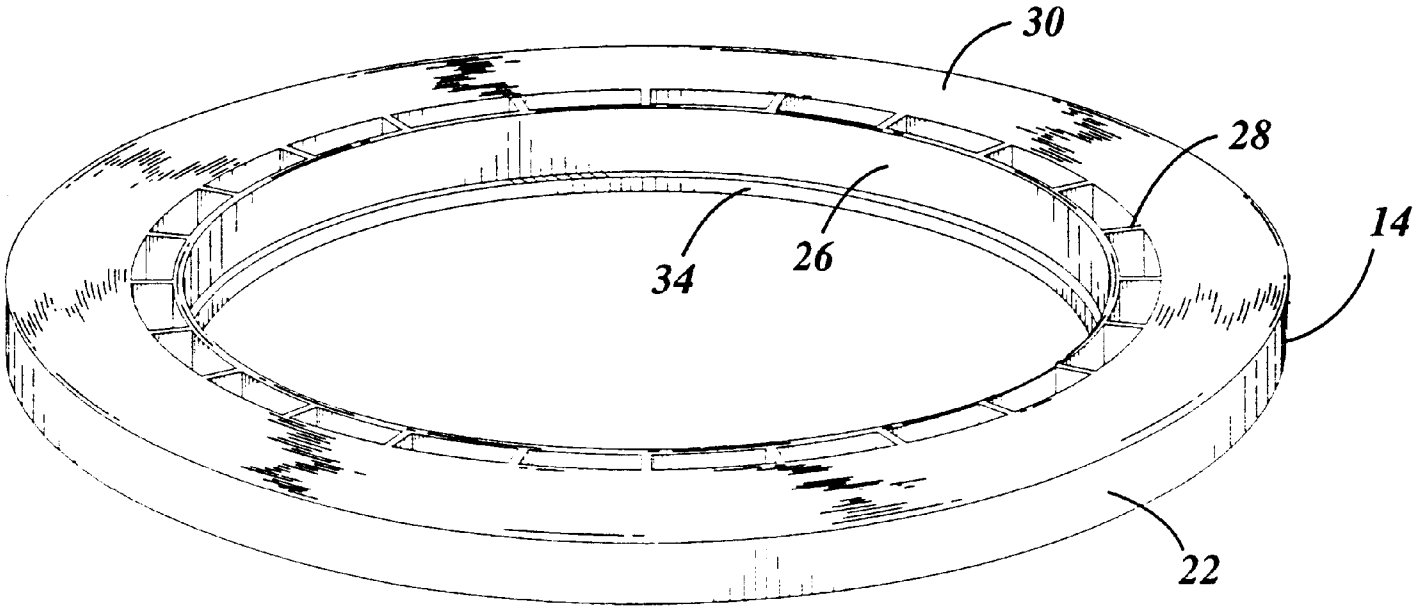
FIG. 2 is a perspective view of the molded plastic annular spacer member of the type shown in FIG. 1.
Figure 3:
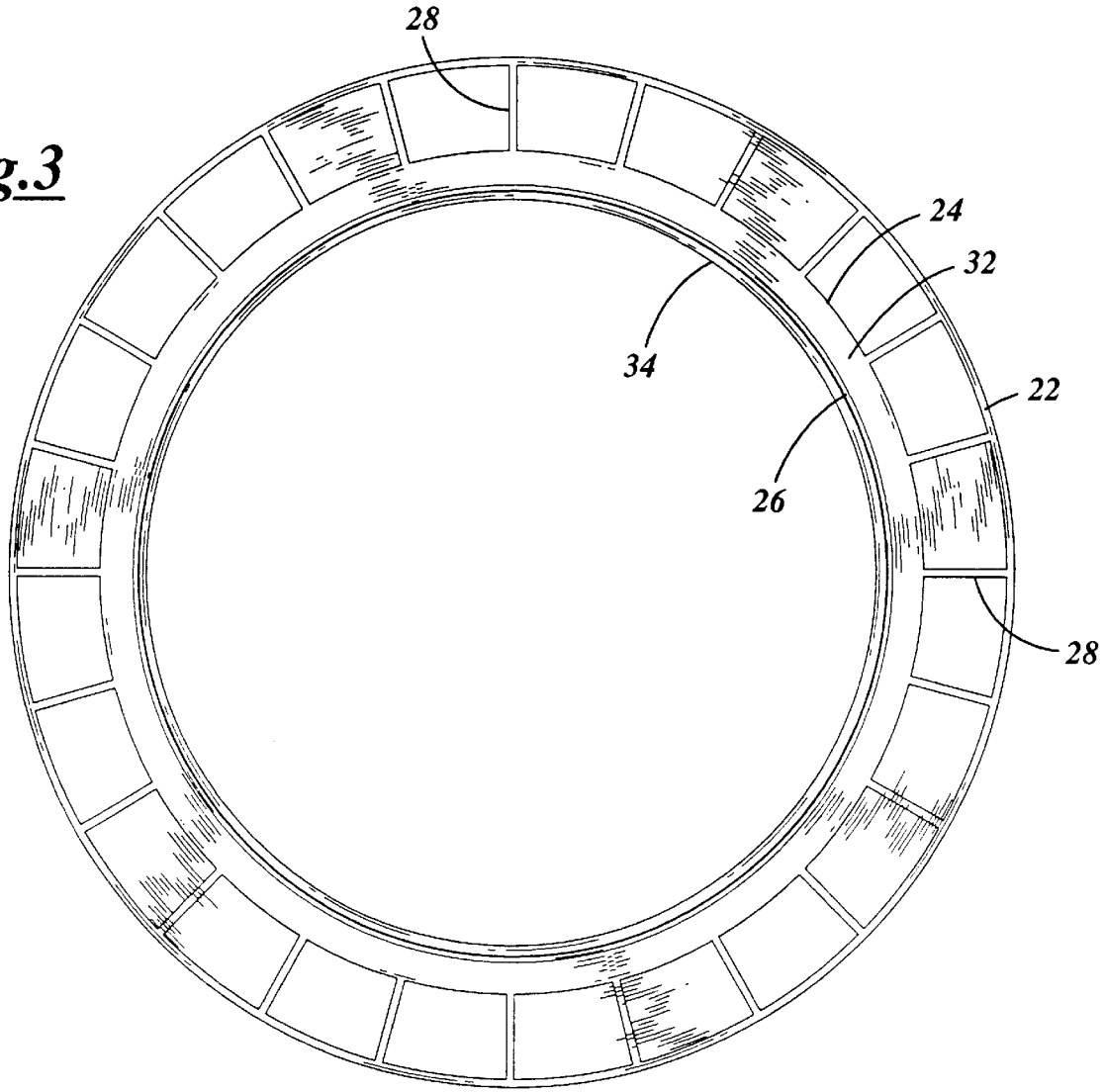
FIG. 3 is a bottom plan view of the spacer member of the type shown in FIG. 2.
Figure 4:
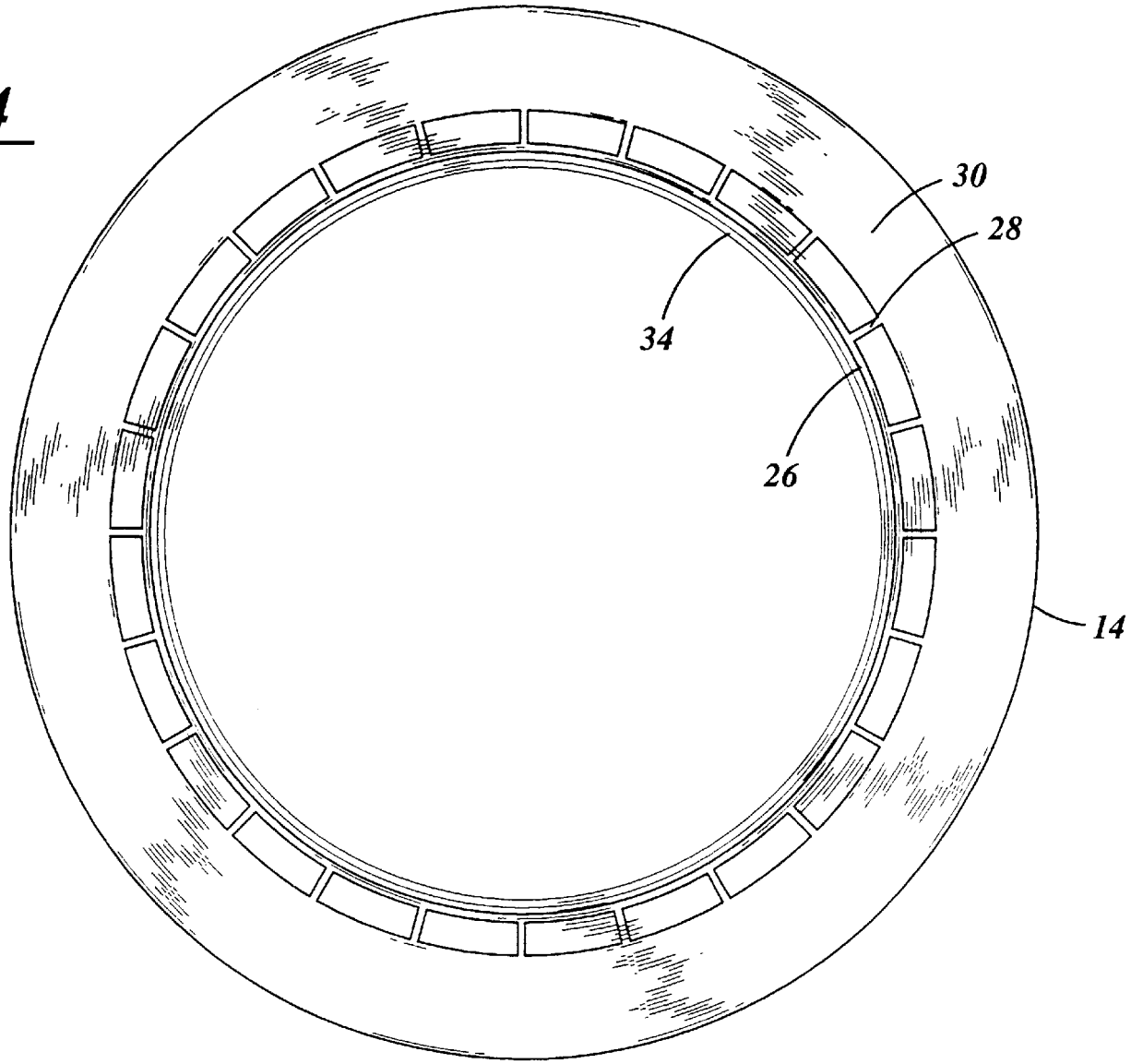
FIG. 4 is a top plan view of the spacer member of the type shown in FIG. 2.

Referring first to FIG. 1, there is shown generally a portion of a manhole structure 10 comprising a manhole base or cone 12, a plurality of extension members 14 of the present invention aligned above the open top end 16 of the cone 12, a support frame 18 aligned above the upper most extension member 14, and a manhole cover 20 aligned above the support frame 18. The extension members 14 shown in FIG. 1 are of the pockets up/down variety.

In the preferred embodiment, the inside dimensions of the open end 16 of the cone 12, the inner sidewall of the pockets up/down extension member 14, and the inner wall of the support frame 18 are all approximately equal. Likewise, the outside dimensions of the cone 12 top surface, the outer annular sidewall of the pockets up/down extension member 14, and the outer wall of the support frame 18 are all approximately equal. Without any limitation intended, each of the embodiments of the extension member 14 of the present invention may be molded in a continuous shape or segmented to allow a plurality of aligned segmented members to create a conforming shape.

FIGS. 2–7 further illustrates the features of a pockets up/down extension member 14 of the present invention. The extension member 14 includes outer, central and inner concentric spaced apart walls 22–26 respectively (see FIGS. 2, 3, and 5), partitions 28 interconnecting the outer, central and inner walls 22–26 (see FIGS. 3, 4 and 6), an upper planar support surface 30 (see FIGS. 2 and 5), a lower planar support surface 32 (see FIGS. 3 and 5), and a lower shoulder or rim 34 (see FIGS. 5 and 6). The central wall 24, inner wall 26, partitions 28, and lower planar support surface 32 together form a plurality of upward facing pockets. The upward facing pockets are adapted for receiving mortar or may remain empty. The lower planar support surface 32 increases the total surface area of the extension member 14 in contact with the upper flat top surface 36 of the base or cone 12.

The central wall 24, outer wall 22, partitions 28, and upper planar support surface 30 together form a plurality of downward facing pockets. By forming the downward facing pockets into the extension member, the overall weight of the extension member 14 and materials required to produce the extension member 14 are reduced. Further, the upper planar support surface 30 increases the total surface area of the extension member 14 that contacts the bottom surface of the support frame 18. Together, the upper planar support surface 30 and lower planar support surface 32 evenly distribute the bearing weight and/or other impact forces from the support frame 18 to the cone or base 12.

Figure 5:
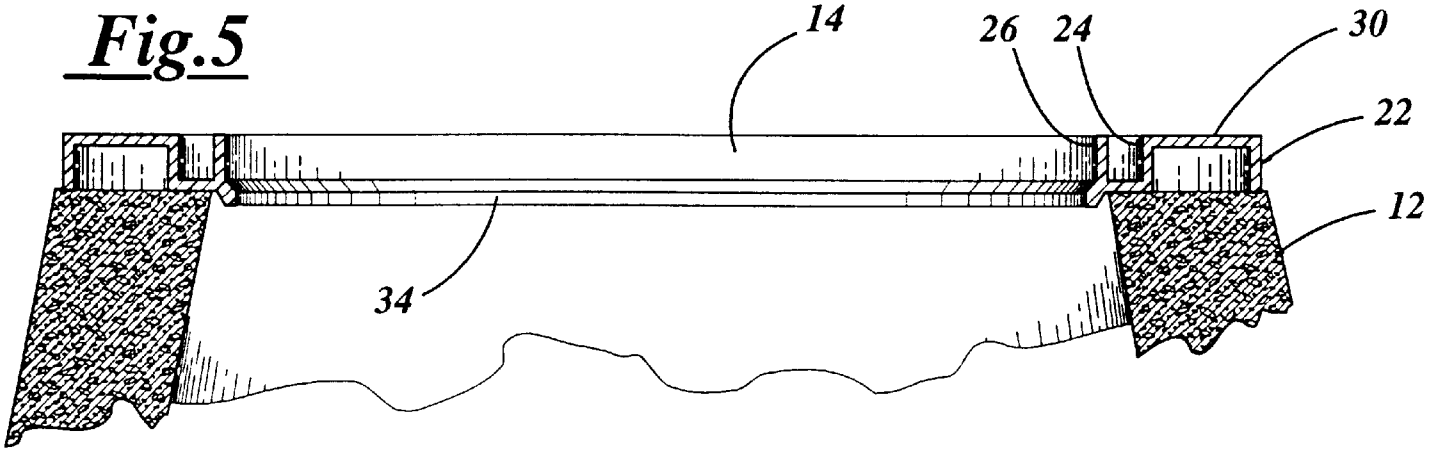
FIG. 5 is a partial sectional fragmentary side elevational view of a manhole cone and a molded plastic annular member of the type shown in FIG. 2 engaged to said cone.
Figure 6:
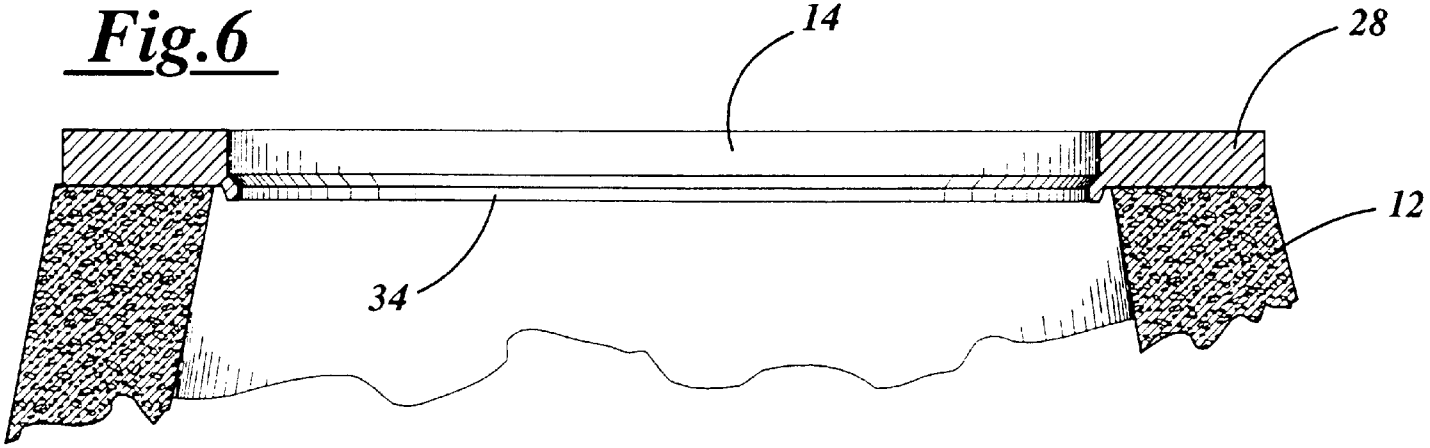
FIG. 6 is a partial sectional fragmentary side elevational view of a manhole cone and a molded plastic annular spacer member shown sectioned through the partitions.
Figure 7:
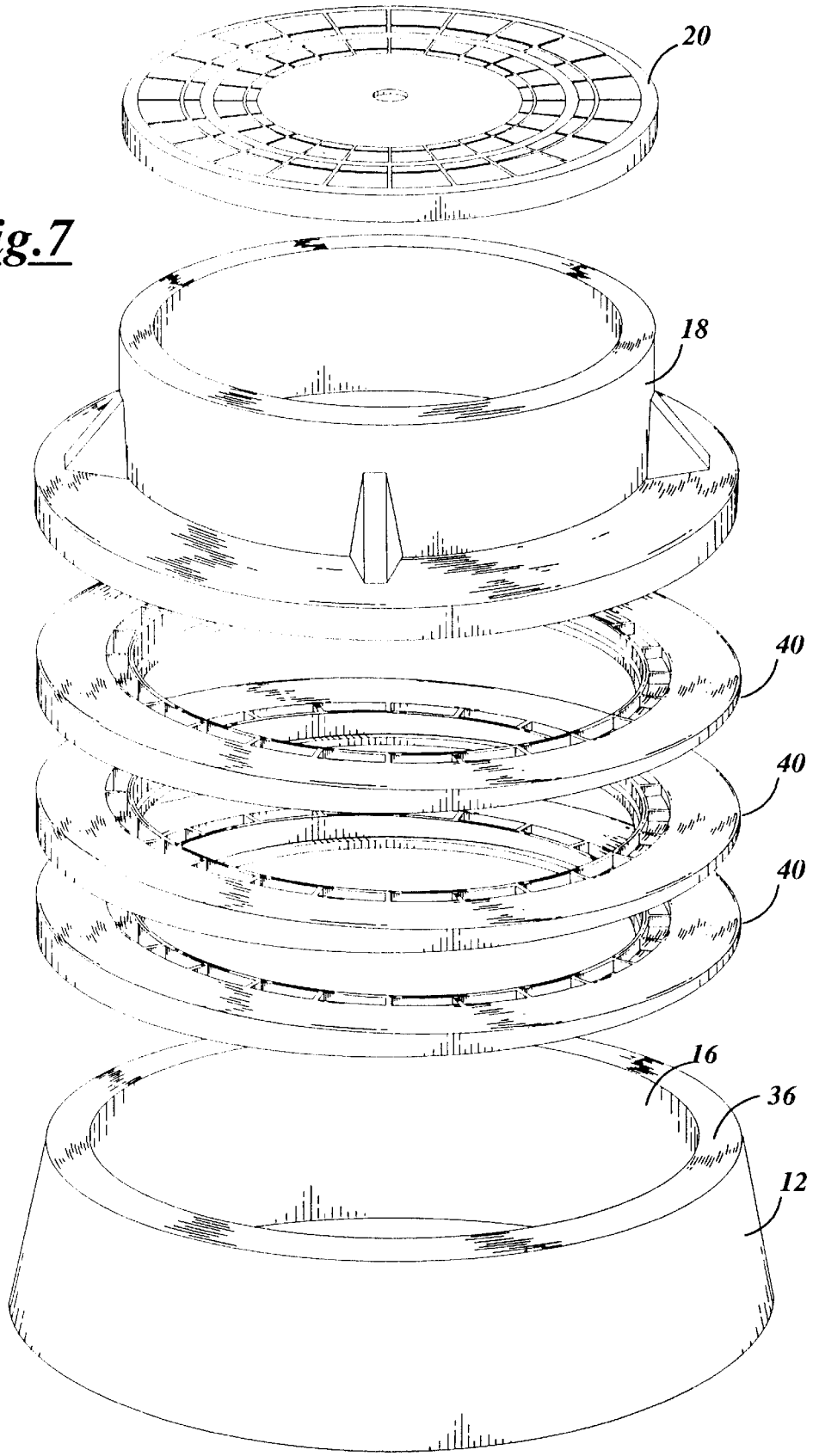
FIG. 7 is an exploded fragmentary perspective view of a manhole cone, a plurality of molded plastic annular spacer members of an alternate embodiment of the present invention, a manhole cover support frame and a manhole cover.
Figure 8:
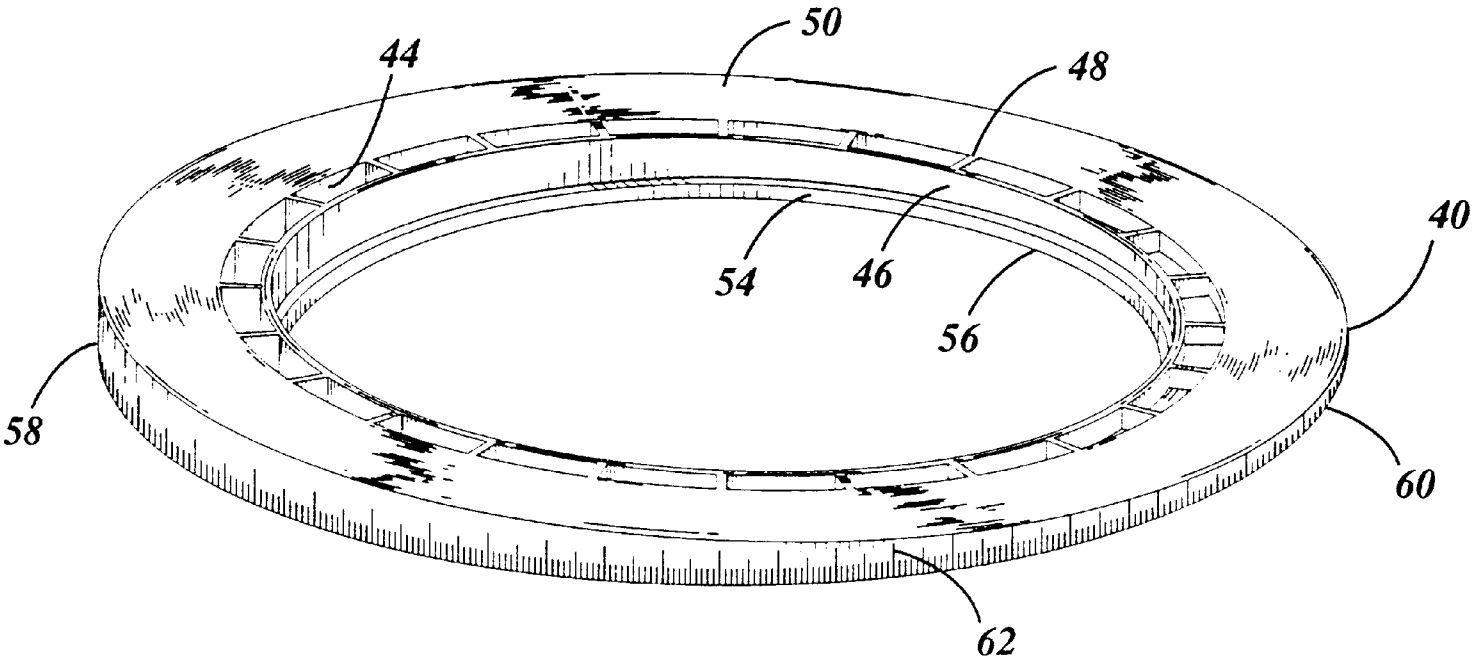
FIG. 8 is a perspective view of the molded plastic annular spacer member of the type shown in FIG. 7.
Figure 9:
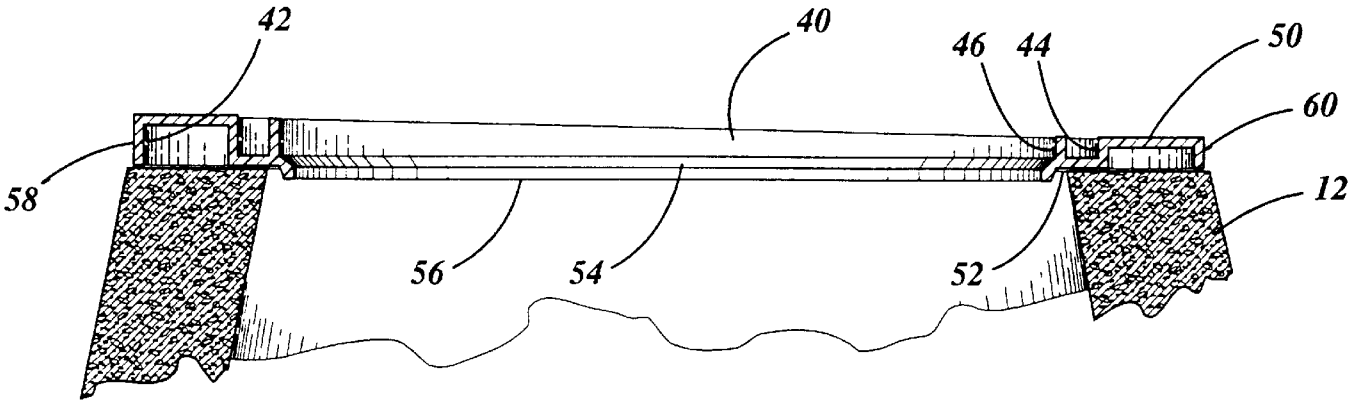
FIG. 9 is a partial sectional fragmentary side elevational view of a manhole cone and a molded plastic annular member of the type shown in FIG. 7 engaged to a top of said cone.

As shown in FIGS. 5 and 6, the inner annular wall 26 has a lower shoulder or rim portion 34 that is vertically offset from the inner wall and extends downward from the inner annular wall 26 and lower planar support surface 32. The outside diameter of the lower annular shoulder 34 is dimensioned to fit and interlock within the top opening of the base or cone 12. When extension members 14 are stacked on top of each other, the outer diameter of the lower annular shoulder 34 is dimensioned to fit snugly within the inner annular wall 26 of another extension member 14.

Referring next to FIGS. 7–10 an alternate embodiment of the pockets up/down extension member 14 is shown. The sloped extension member 40 includes outer 42, central 44 and inner 46 concentric spaced apart walls (see FIG. 9), partitions 48 interconnecting the outer 42, central 44 and inner 46 walls (see FIG. 8), an upper planar support surface 50 (see FIGS. 8 and 9), a lower planar support surface 52 (see FIGS. 8 and 9), and a lower shoulder or rim 54 (see FIGS. 9 and 10). The central wall 44, inner wall 46, partitions 48, and lower planar support surface 52 together form a plurality of upward facing pockets. The central wall 44, outer wall 42, partitions 48, and upper planar support surface 50 together form a plurality of downward facing pockets. The inner wall 46 includes a lower annular shoulder 54 extending therefrom, wherein the shoulder 54 tapers from a first thickness adjacent the inner wall 46 to a smaller second thickness proximate the free end 56 of the annular shoulder 54. The taper allows a plurality of sloped extension members 40 to be stacked on top of each other with the lower planar surface 52 of one member in contact with the upper planar surface 50 of another (see FIG. 10). The taper of the annular shoulder 54 should be approximately equal to or greater than the degree of slope of the upper planar surface 50.

Figure 10:
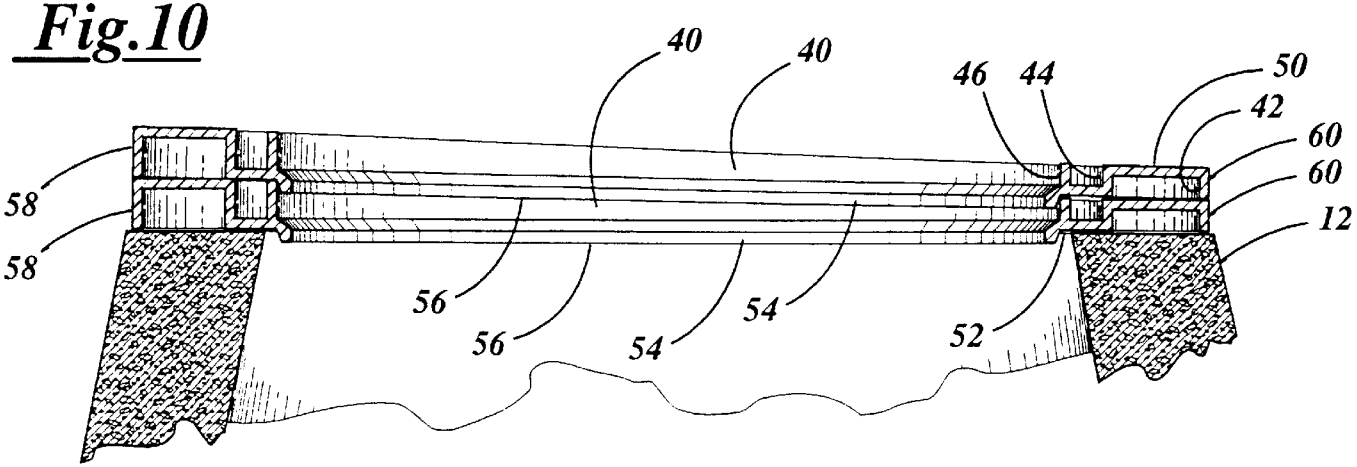
FIG. 10 is a partial sectional fragmentary side elevational view of a manhole cone and two molded plastic annular members of the type shown in FIG. 2 stacked on top of said cone.
Figure 11:
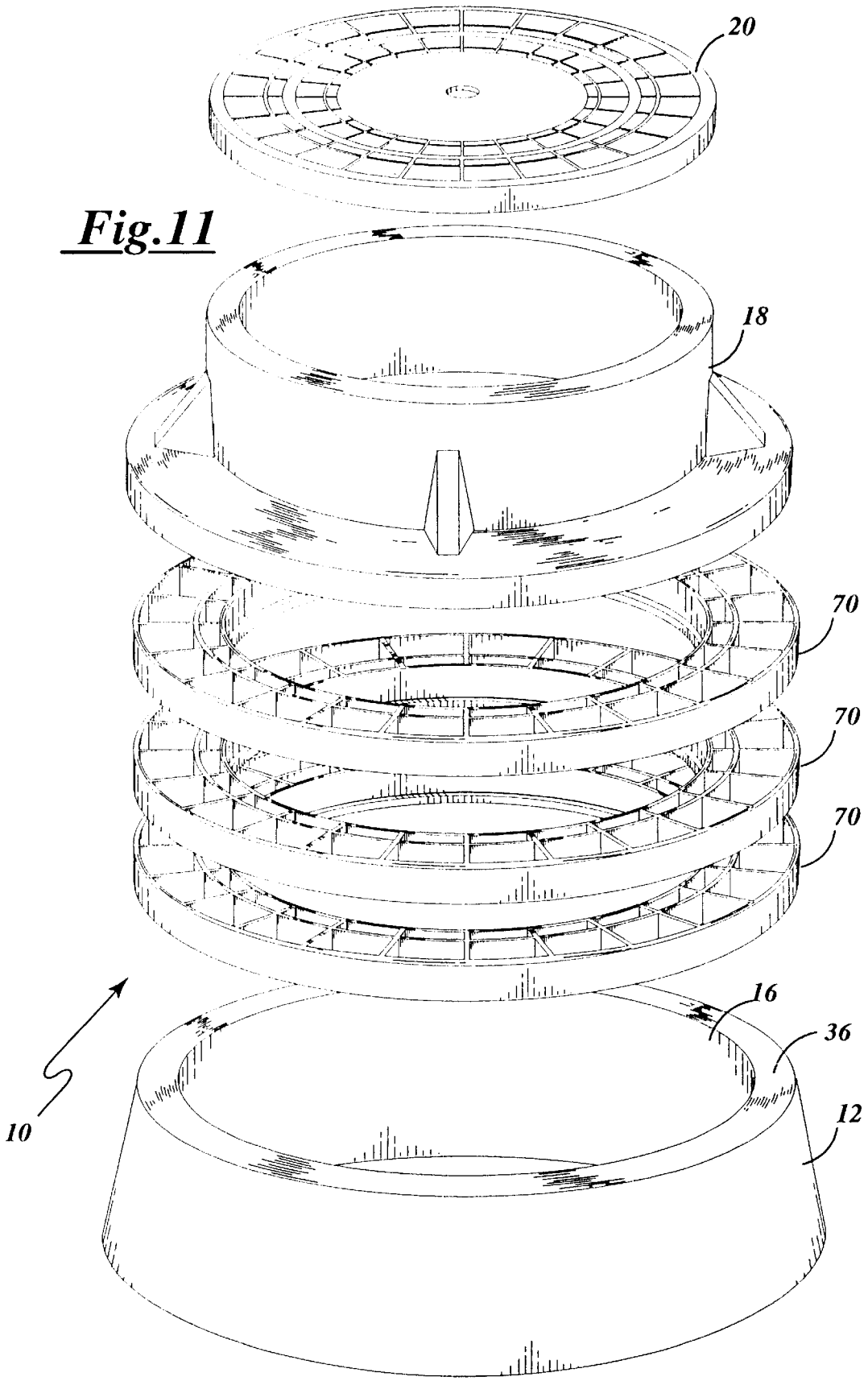
FIG. 11 is an exploded fragmentary perspective view of a manhole cone, a plurality of molded plastic annular spacer members of an alternate embodiment of the present invention, a manhole cover support frame and a manhole cover.
Figure 12:
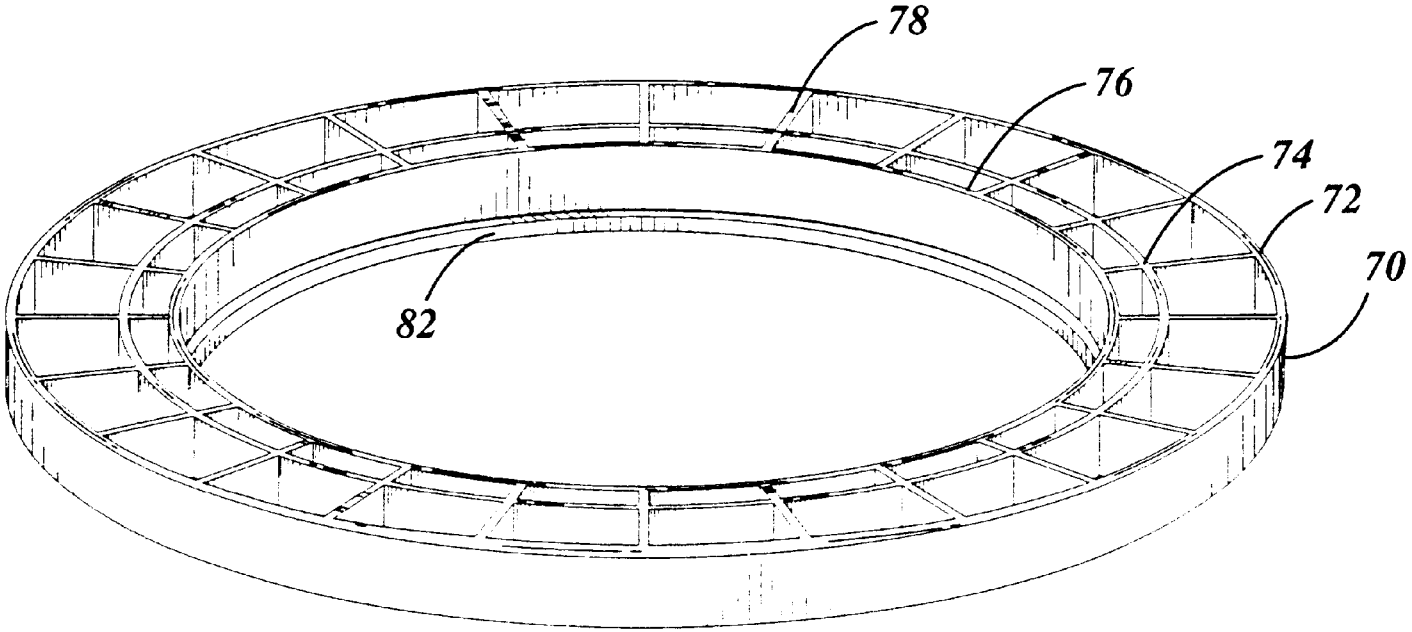
FIG. 12 is a perspective view of the molded plastic annular spacer member of the type shown in FIG. 7.
Figure 13:
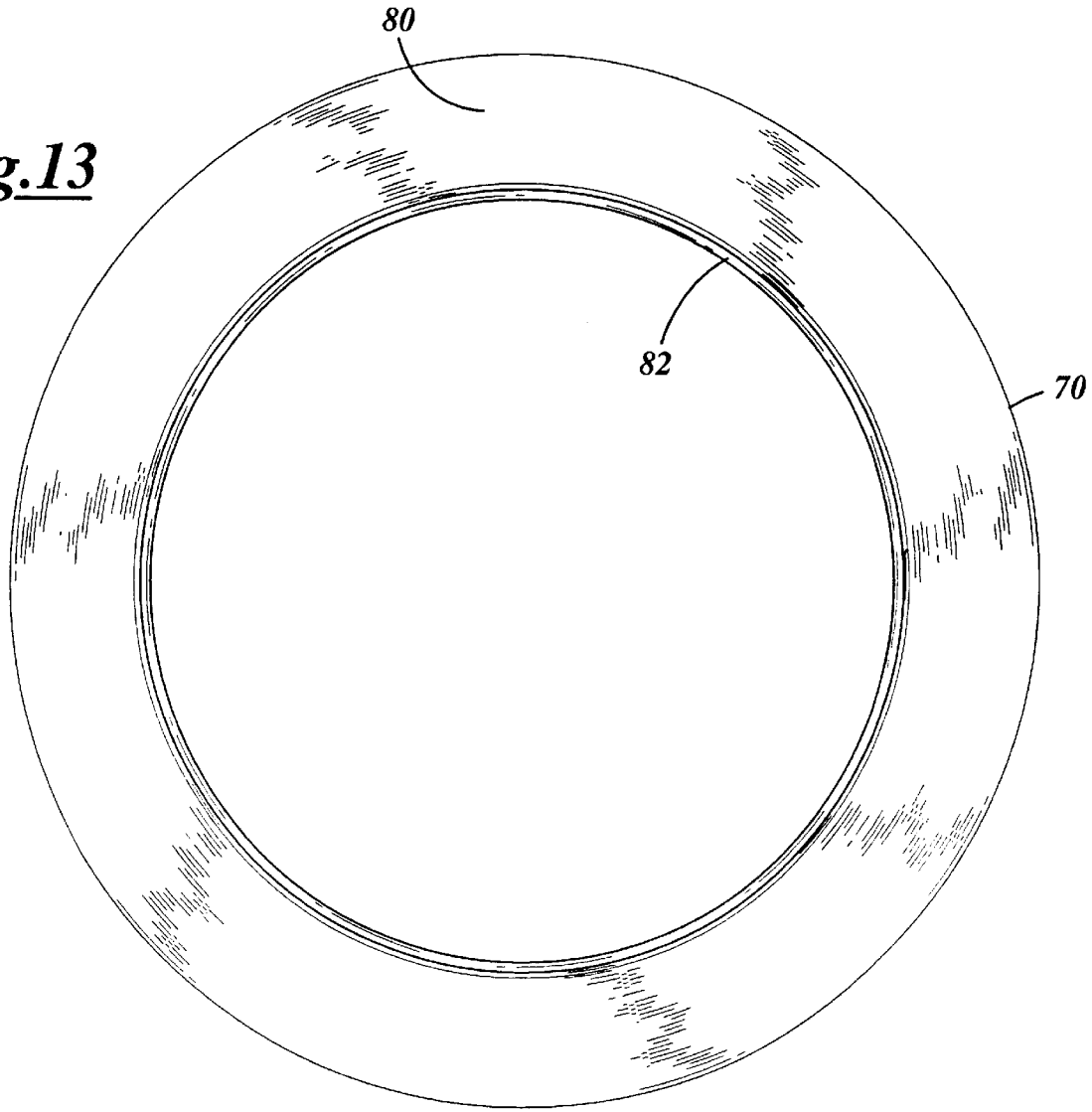
FIG. 13 is a bottom plan view of the spacer member of the type shown in FIG. 12.
Figure 14:
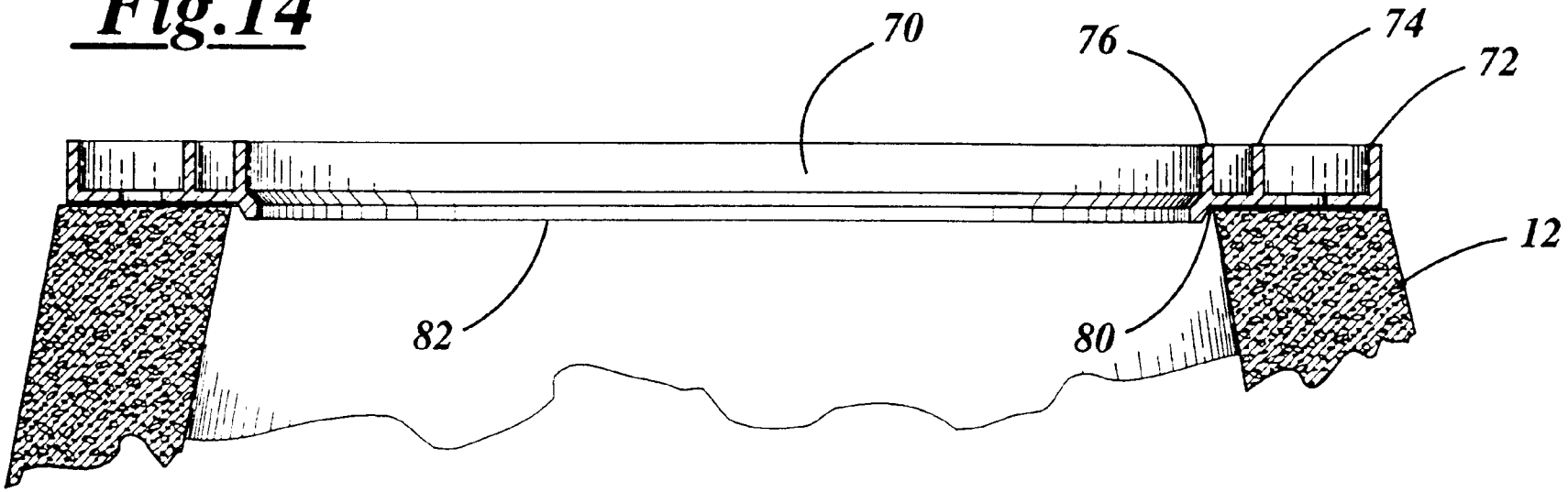
FIG. 14 is a partial sectional fragmentary side elevational view of a manhole cone and a molded plastic annular member of the type shown in FIG. 12 engaged to a top of said cone.

The inner 46, central 44 and outer 42 walls have a height dimension that decreases uniformly from a first height dimension associated with a first side 58 of the walls to a second height dimension associated with a second side 60 of the walls, wherein the first height dimension is aligned opposite the second height dimension. The decreasing height dimension creates a sloping upper planar support surface 50 that allows the user to position the central axis of the support frame 18 at an angle relative to the vertical axis of the manhole base 12. Those skilled in the art will appreciate that at least one of the outer, central and/or inner walls may decrease uniformly (independent of the other walls) from a first height dimension associated with a first side position to a second height dimension associated with a second side position aligned opposite the first side, thereby creating a sloped bearing surface. An outer surface of the extension member 40 may include indicia 62 formed thereon to identify and indicate to the user the sides 58 and 60 of the first and second height dimensions respectively of the extension member 40. Without any limitation intended, those skilled in the art will appreciate that the indicia 62 may be formed on the extension member 40 by either molding the markings as part of the extension member 40, applying a label having markings to the outer surface, or machining/stamping the markings into the outer surface. Although FIG. 10 shows the sides 58 of each extension member aligned with the other, those skilled in the art will appreciate that the markings 62 may be used to align the first height dimensions of the extension members 40 at a desired offset angle relative to the other, thereby creating a desired complex angle of slope.

Turning now to FIGS. 11–14 another alternate embodiment of the extension member 14 is shown. The pockets up extension member 70 includes outer 72, central 74 and inner 76 concentric spaced apart walls (see FIGS. 12 and 14), partitions 78 interconnecting the outer 72, central 74 and inner 76 walls (see FIGS. 11 and 12), a lower planar support surface 82 (see FIGS. 13 and 14), and a lower shoulder or rim 84 (see FIG. 14). The central wall 74, outer wall 72, inner wall 76, partitions 78, and lower planar support surface 80 together form a plurality of upward facing pockets. The inner wall 76 includes the lower annular shoulder 82 extending therefrom. The pockets up are adapted for receiving mortar, once the extension member 70 has been aligned and engaged to the top surface of the base or cone. When hardened, the mortar provides an enhanced upper support surface. Apertures 90 extending through the lower support surface 80 provide a structure for the mortar to settle into, thereby securing the mortar to the extension member 70.

Figure 15:
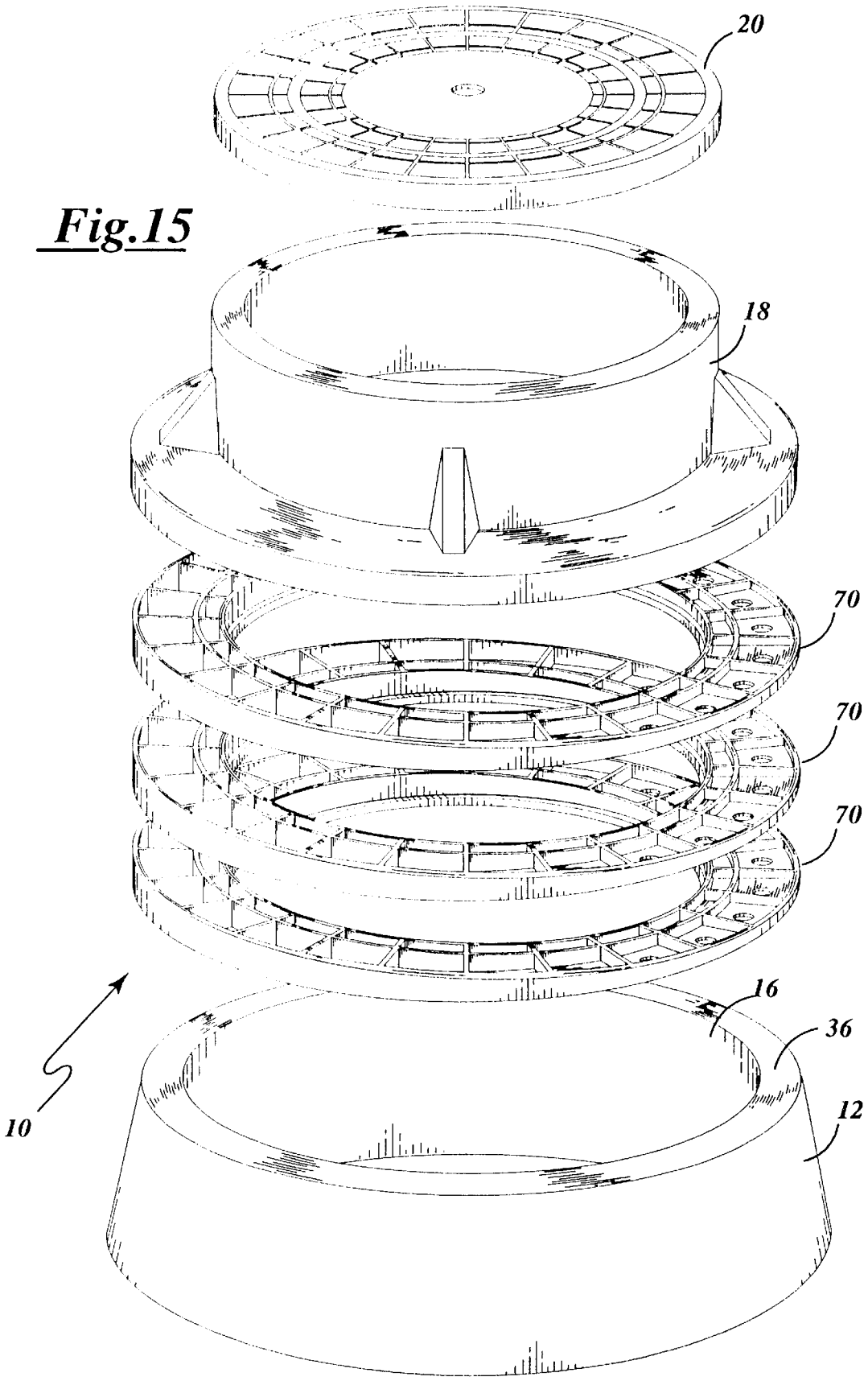
FIG. 15 is an exploded fragmentary perspective view of a manhole cone, a plurality of molded plastic annular spacer members of an alternate embodiment of the present invention, a manhole cover support frame and a manhole cover.
Figure 16:
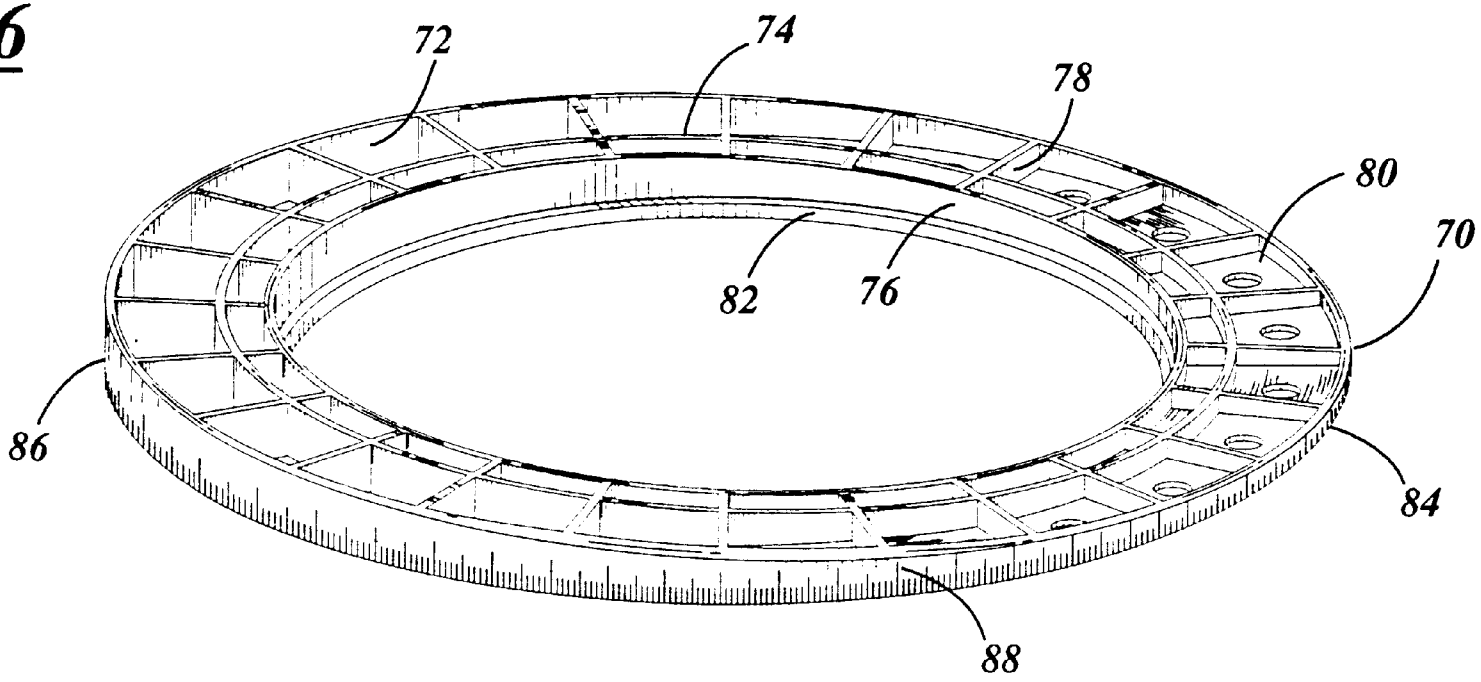
FIG. 16 is a perspective view of the molded plastic annular spacer member of the type shown in FIG. 15.
Figure 17:
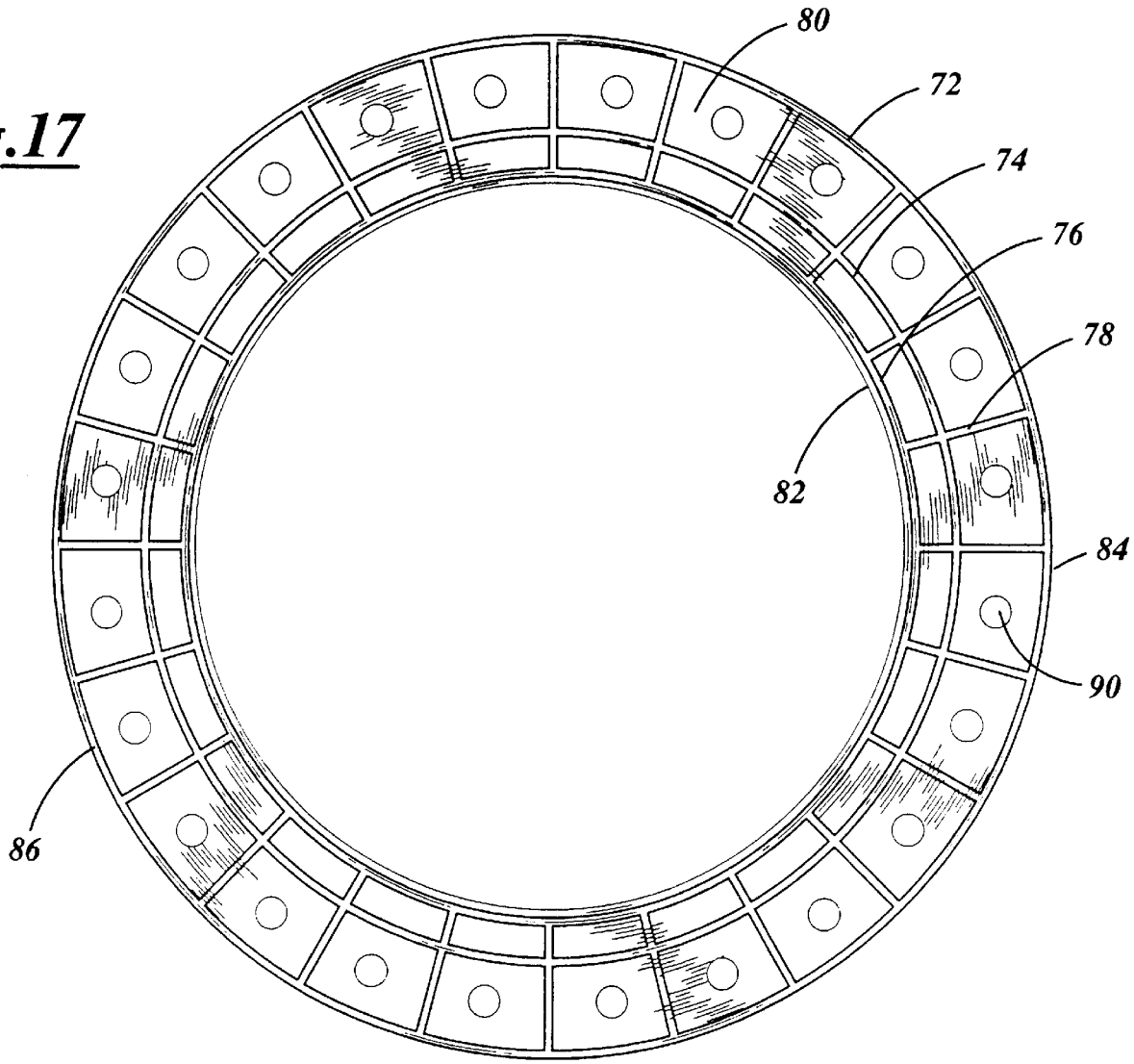
FIG. 17 is a top plan view of the spacer member of the type shown in FIG. 17.

FIGS. 15–17 shows an alternate embodiment of the pockets up extension member 70. The inner 76, central 74 and outer 72 walls have a height dimension that decreases uniformly from a first height dimension associated with a first side 84 of the walls to a second height dimension associated with a second side 86 of the walls, wherein the first height dimension is aligned opposite the second height dimension. The decreasing height dimension creates a sloping upper planar support surface that allows the user to position the central axis of the support frame 18 at an angle relative to the vertical axis of the manhole base 12. An outer surface of the extension member 70 may include indicia 88 formed thereon to identify and indicate to the user the first and second height dimensions of the extension member 70.

Figure 18:
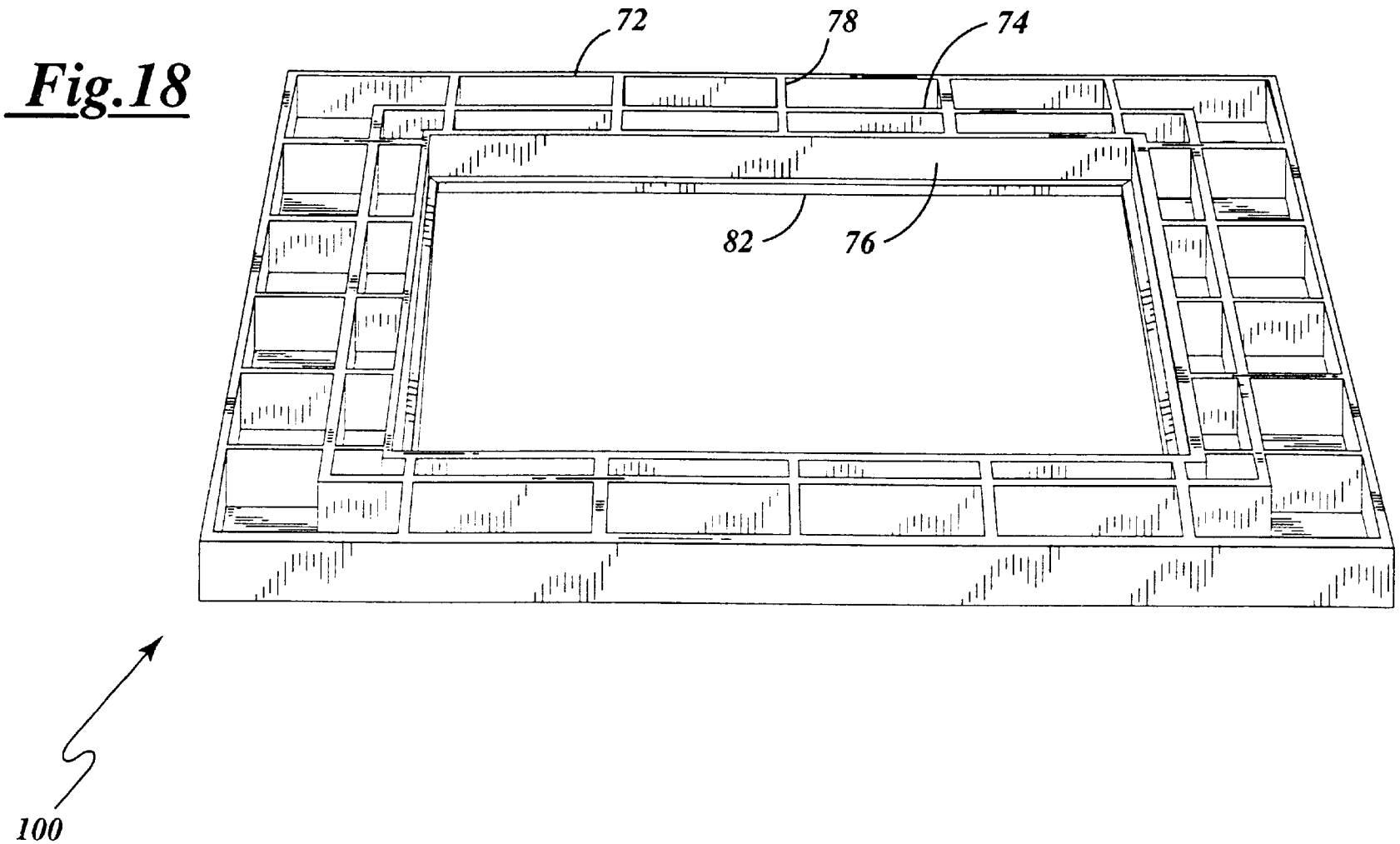
FIG. 18 is a perspective view of a molded plastic member of an alternate embodiment of the present invention adaptable for use in a catch basin.

FIG. 18 shows an extension member 100 of the present invention rectangular in shape, thereby adaptable for placement above the base or cone 12 of a catch basin. Those skilled in the art will appreciate that the various embodiments of the extension member described above may be modified to form a rectangular shape or other shape consistent with the opening of the base, cone or top slab.

Prior to laying down the asphalt of the surfacing or resurfacing layer, the workers remove and set aside the existing support frame 18. They then align and position at least one plastic annular member 14, 40, 70 or 100 onto the cone's support surface. The lower annular shoulder 34, 54, or 82 respectively extends downward into the central opening of the cone 12 with the ledge engaging the cone support surface. A caulking of suitable known construction may be applied to the support surface to form a water tight seal.

The top support surface of the cone 12 is relatively flat and is positioned parallel to the horizon. The molded plastic annular members 14, 40, 70 or 100 rest directly on the top support surface of the cone 12. The desired number of conforming plastic members 14, 40, 70 or 100 are stacked with the lower annular shoulder engaging the inner sidewall of the extension member 14, 40, 70 or 100. Once the desired number of annular members 14, 40, 70 or 100 have been stacked to accommodate the thickness of the surfacing or resurfacing layer to be laid down, the support frame 18 is aligned in position with the support frame footing resting on the planar support surface of the uppermost annular member. The manhole cover or grating 20 is then positioned on the support frame. The road is then surfaced or resurfaced with the level of the manhole cover or grating 20 being equal to the road level. The surfacing material precludes lateral shifting of the support frame 18 and the annular members 14, 40, 70 or 100.

Without any limitation intended, to help reduce the demand for new plastics, the molded plastic annular member 14, 40, 70 or 100 is preferably constructed from recycled plastic with melting points greater than about 400° F. and having a relatively high compression rate. Plastic members 14, 40, 70 or 100 molded from recycled plastic having the above listed qualities may have the ability to withstand a crushing load exceeding 65,000 psi. Of course, other suitable materials may be used without deviating from the present invention.

As recognized above, when constructing or resurfacing a roadway on a hillside, both the vertical and horizontal axes or slope of the roadway may not be parallel to the vertical and horizontal axis of the manhole base or cone 12. If the desired slope requires a complex angle (a slope in both the horizontal and vertical directions), then a plurality of sloped plastic members 40 or 70 such as those shown in FIGS. 8 and 16 may be used to create an upper support surface at the desired complex angle.

The markings on the outer surface of the extension member may be used to assist the user in quickly determining the resulting slope of the upper surface and matching this slope with the desired alignment within the roadway. As described above, when several plastic members are stacked together, the markings of each plastic member may be aligned relative to the other to thereby create the desired complex slope angle and/or increase the angle of the slope relative to the vertical axis of the base or cone. If the position associated with the first height dimension of each stacked plastic member is offset relative to the other, the slope of the uppermost plastic member is aligned at a complex angle relative to the vertical axis of the manhole base or cone, thereby allowing the cover or grating to remain flush with a resurfaced roadway located on a banking hillside.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and the operating procedures, can be accomplished without departing from the scope of the invention itself.

What is claimed is:

1. An extension adapted to be disposed between an open top surface of a base of a manhole or catch basin and a bottom surface of a support frame, said extension comprising:

a molded plastic member having a central opening for access therethrough and a shape conforming to an open top surface of a base, and further having outer, central, and inner concentric, spaced-apart walls, each wall having inner and outer surfaces, wherein a first planar support surface extends perpendicularly from at least one of a lower and upper edge of said outer wall to said central wall and a second planar support surface extends perpendicularly from at least one of a lower and upper edge of said inner wall to said central wall, to provide planar surfaces of support, said inner wall having a lower annular shoulder extending therefrom.

2. The extension member as recited in claim 1, wherein said inner and central walls are interconnected by a plurality of partitions extending radially from said inner wall to said central wall to create a corresponding plurality of pocket spaces.

3. The extension member as recited in claim 1, wherein said outer and central walls are interconnected by a plurality of partitions extending radially from said central wall to said outer wall to create a corresponding plurality of pocket spaces.

4. The extension member as recited in claim 2, wherein said outer and central walls are interconnected by a plurality of partitions extending radially from said central wall to said outer wall to create a corresponding plurality of pocket spaces.

5. The extension member as recited in claim 1, wherein said inner, central, and outer concentric spaced-apart walls are interconnected by a plurality of partitions extending radially from said inner wall to said outer wall to create a corresponding plurality of pocket spaces.

6. The extension member as recited in claim 1, wherein said inner, central and outer concentric, spaced-apart walls have a uniform height dimension.

7. The extension member as recited in claim 1, wherein the outer wall of said extension member has a height dimension that decreases uniformly from a first height dimension associated with a first side of said outer wall to a second height dimension associated with a second side of said outer wall aligned opposite said first side.

8. The extension member as recited in claim 1, wherein the central wall of said extension member has a height dimension that decreases uniformly from a first height dimension associated with a first side of said central wall to a second height dimension associated with a second side of said central wall aligned opposite said first side.

9. The extension member as recited in claim 1, wherein the inner wall of said extension member has a height dimension that decreases uniformly from a first height dimension associated with a first side of said inner wall to a second height dimension associated with a second side of said inner wall aligned opposite said first side.

10. The extension member as recited in claim 5, wherein the outer wall of said extension member has a height dimension that decreases uniformly from a first height dimension associated with a first side of said outer wall to a second height dimension associated with a second side of said outer wall aligned opposite said first side.

11. The extension member as recited in claim 5, wherein the central wall of said extension member has a height dimension that decreases uniformly from a first height dimension associated with a first side of said central wall to a second height dimension associated with a second side of said central wall aligned opposite said first side.

12. The extension member as recited in claim 5, wherein the inner wall of said extension member has a height dimension that decreases uniformly from a first height dimension associated with a first side of said inner wall to a second height dimension associated with a second side of said inner wall aligned opposite said first side.

13. The extension member as recited in claim 7, further including indicia formed on said extension member to identify said first height dimension of said extension member.

14. The extension member as recited in claim 5 in which said extension member is molded in a rectangular shape.

15. An extension member adapted to be disposed between an open top surface of a base of a manhole or catch basin and a bottom surface of a support frame, said extension member comprising:

a molded plastic member having a central opening for access therethrough and a shape conforming to an open top surface of a base, and further having outer and inner concentric, spaced-apart, walls having inner and outer surfaces and interconnected by a plurality of partitions radially extending from said inner wall to said outer wall to create a corresponding plurality of pocket spaces, said inner and outer spaced apart walls having a planar support surface extending perpendicularly therebetween, from a lower edge of each said inner and outer spaced apart walls to provide a bottom surface of support, wherein at least one of said inner and outer concentric spaced-apart walls has a height dimension that decreases uniformly from a first height dimension to a second height dimension, said second height dimension being aligned opposite said first height dimension.

16. The extension member as recited in claim 15, wherein at least one of said inner and outer concentric spaced-apart walls has an upper planar support surface extending perpendicularly from an upper edge thereof, to provide an upper surface of support.

17. The extension member as recited in claim 15, further including indicia formed on said extension member to identify said first height dimension of said extension member.

18. The extension member as recited in claim 15 in which said member is molded in a rectangular shape.

19. The extension member as recited in claim 15 wherein said inner wall includes a lower annular shoulder extending therefrom.

20. An extension member adapted to be disposed between an open top surface of a base of a manhole or catch basin and a bottom surface of a support frame, said extension member comprising:

a molded plastic member having a central opening for access therethrough and a shape conforming to the open top surface of the base, and further having outer, central, and inner concentric, spaced-apart walls, each wall having inner and outer surfaces and interconnected by a plurality of partitions radially extending from said inner wall to said outer wall to create a corresponding plurality of pocket spaces, wherein at least one of said inner and outer concentric spaced-apart walls has a lower planar support surface extending perpendicularly towards said central wall from a lower edge thereof to provide a bottom surface of support and at least one of said inner and outer concentric spaced-apart walls has an upper planar support surface extending perpendicularly towards said central wall from an upper edge thereof to provide an upper surface of support, said inner wall having an upper and a lower section laterally offset in opposite directions relative to a center section to define an upper and a lower shoulder extending from said center section.

21. The extension member as recited in claim 20, wherein the outer wall of said extension member has a height dimension that decreases uniformly from a first height dimension associated with a first side of said outer wall to a second height dimension associated with a second side of said outer wall aligned opposite said first side.

22. The extension member as recited in claim 21, further including indicia formed on said extension member to identify said first height dimension of said extension member.

23. The extension member as recited in claim 20, wherein the inner wall of said extension member has a height dimension that decreases uniformly from a first height dimension associated with a first side of said inner wall to a second height dimension associated with a second side of said inner wall aligned opposite said first side.

24. The extension member as recited in claim 23, further including indicia formed on said extension member to identify said first height dimension of said extension member.

25. An extension member adapted to be disposed between an open top surface of a base of a manhole or catch basin and a bottom surface of a support frame, said extension member comprising:

a molded plastic member having a central opening for access therethrough and a shape conforming to an open top surface of a base, and further having outer, central, and inner concentric, spaced-apart walls, each wall having inner and outer surfaces and interconnected by a plurality of partitions radially extending from said inner wall to said outer wall to create a corresponding plurality of pocket spaces, wherein a first planar support surface extends perpendicularly from at least one of a lower and upper edge of said outer wall to said central wall and a second planar support surface extends perpendicularly from at least one of a lower and upper edge of said inner wall to said central wall, to provide planar surfaces of support, said outer wall further having a height dimension that decreases uniformly from a first height dimension associated with a first side of said outer wall to a second height dimension associated with a second side of said outer wall aligned opposite said first side.

26. The extension member as recited in claim 25, wherein said inner wall has an upper and a lower section laterally offset in opposite directions relative to a center section to define an upper and a lower shoulder extending from said center section.

27. The extension member as recited in claim 25, wherein the inner wall of said extension member has a height dimension that decreases uniformly from a first height dimension associated with a first side of said inner wall to a second height dimension associated with a second side of said inner wall aligned opposite said first side.

28. The extension member as recited in claim 25, further including indicia formed on said extension member to identify said first height dimension of said extension member.

29. An extension member adapted to be disposed between an open top surface of a base of a manhole or catch basin and a bottom surface of a support frame, said extension member comprising:

a molded plastic member having a central opening for access therethrough and a shape conforming to an open top surface of a base, and further having outer and inner concentric spaced-apart walls having inner and outer surfaces and interconnected by a plurality of partitions radially extending from said inner wall to said outer wall to create a corresponding plurality of pocket spaces, wherein said molded plastic member has a height dimension that decreases uniformly from a first height dimension to a second height dimension, said second height dimension being aligned opposite said first height dimension.

30. The extension member as recited in claim 29, wherein said inner and outer spaced apart walls have a planar support surface extending perpendicularly therebetween, from a lower edge of each said inner and outer spaced apart walls to provide a bottom surface of support.

31. The extension member as recited in claim 29, wherein at least one of said inner and outer concentric spaced-apart walls has an upper planar support surface extending perpendicularly from an upper edge thereof, to provide an upper surface of support.

32. The extension member as recited in claim 29, further including indicia formed on said extension member to identify said first height dimension of said extension member.

33. The extension member as recited in claim 29 in which said member is molded in a rectangular shape.

34. The extension member as recited in claim 29, wherein said inner wall includes a lower annular shoulder extending therefrom.

35. The extension member as recited in claim 30, wherein a plurality of apertures extend through said bottom surface of support.

36. The extension member as recited in claim 34, further including indicia formed on said extension member to identify said first height dimension of said extension member.

37. An extension member adapted to be disposed between an open top surface of a base of a manhole or catch basin and a bottom surface of a support frame, said extension member comprising:

a molded plastic member having a central opening and a shape conforming to an open top surface of a base, and further having outer and inner concentric spaced-apart walls having inner and outer surfaces and interconnected by a plurality of partitions radially extending from said inner wall to said outer wall to create a corresponding plurality of pocket spaces, said inner wall including a lower annular shoulder extending therefrom, and said molded plastic member having a height dimension that decreases uniformly from a first height dimension to a second height dimension, said second height dimension being aligned opposite said first height dimension.

38. The extension member as recited in claim 37, wherein said inner and outer spaced apart walls have a planar support surface extending perpendicularly therebetween, from a lower edge of each said inner and outer spaced apart walls to provide a bottom surface of support.

39. The extension member as recited in claim 37, wherein at least one of said inner and outer concentric spaced-apart walls has an upper planar support surface extending perpendicularly from an upper edge thereof, to provide an upper surface of support.

40. The extension member as recited in claim 37, further including indicia formed on said extension member to identify said first height dimension of said extension member.

41. The extension member as recited in claim 37 in which said member is molded in a rectangular shape.

42. The extension member as recited in claim 37, wherein a plurality of apertures extend through said bottom surface of support.

43. The extension member as recited in claim 41, further including indicia formed on said extension member to identify said first height dimension of said extension member.

* * * * *